US006227939B1

(12) United States Patent
Monroe

(10) Patent No.: US 6,227,939 B1
(45) Date of Patent: May 8, 2001

(54) TEMPERATURE CONTROLLED CHEMICAL MECHANICAL POLISHING METHOD AND APPARATUS

(75) Inventor: Michael G. Monroe, Corvallis, OR (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/490,519

(22) Filed: Jan. 25, 2000

(51) Int. Cl.[7] ..... B24B 49/00; B24B 51/00
(52) U.S. Cl. ..... 451/7; 451/53
(58) Field of Search ..... 451/41, 5, 7, 53, 451/285, 287, 288, 259

(56) References Cited

U.S. PATENT DOCUMENTS 5,036,630 * 8/1991 Kaanta et al. ..... 451/53
5,605,488 * 2/1997 Ohashi et al. ..... 451/7
5,873,769 * 2/1999 Chiou et al. ..... 451/7
5,882,244 * 3/1999 Hiyama et al. ..... 451/7
6,000,997 * 12/1999 Kao et al. ..... 451/53
6,007,408 * 12/1999 Sandhu ..... 451/53
6,077,151 * 6/2000 Black et al. ..... 451/53

* cited by examiner

*Primary Examiner*—Derris H. Banks

(57) ABSTRACT

Apparatus and method for producing more uniformly polished wafers using chemical mechanical polishing (CMP). The present invention recognizes that wafer temperature is important in achieving uniform polishing. Mechanisms are disclosed for regulating carrier and carrier plate temperatures and thereby regulating the temperature of an attached wafer. Mechanisms are also disclosed that insulate a wafer, at least to some extent, from undesired heat sinks or heat sources.

15 Claims, 1 Drawing Sheet

TEMPERATURE CONTROLLED CHEMICAL MECHANICAL POLISHING METHOD AND APPARATUS

FIELD OF THE INVENTION

The present invention relates to chemical mechanical polishing (CMP) of semiconductor dies.

BACKGROUND OF THE INVENTION

FIG. 1 is a cross-sectional view of a representative MOSFET transistor 10 before CMP. The transistor includes a gate region (G) and dopant wells 13 that form a source region (S) and a drain region (D). Electrical connection to the S,G and D regions is typically achieved through vias 16–18 which are made of a conductive material 19, typically tungsten (W) or the like. While the present invention is particularly well suited for treatment of tungsten or like material, it should be realized that the teachings of the present invention are applicable to other conductive materials including but not limited to copper, nickel, silver, gold and other metallic and non-metallic conductive materials.

FIG. 1 represents an in progress stage of transistor fabrication. After deposition of conductive material to fill the via openings, conductive material above the vias is removed to provide appropriate signal isolation. The conductive material is typically removed with a combination of a chemical etchant and mechanical abrasion or polishing.

FIG. 2 illustrates a typical CMP arrangement 21 that includes one or more wafer carriers 20 (three are shown) and a platen 22 provided thereunder for abrasive polishing. A slurry that contains a chemical etchant and abrasive grains is preferably provided on the top surface 23 of the platen. Each carrier 20 holds a wafer 5 and the wafers are brought into contact with the rotating platen (which rotates in the direction of arrow A). The carriers also preferably rotate. The rotating platen machines away the conductive material that has been weakened by the etchant.

While this technique removes conductive material, the amount of conductive material removed from each wafer or from different regions of the same wafer may differ by a significant amount. Stated in other words, prior art polishing processes tend to produce inconsistently or unevenly polished wafers. In prior art assessments, these inconsistencies were often attributed to misalignment of the carriers and the platen and the resultant misdistribution of polishing forces. The below discussed present invention, however, teaches that inconsistently polished wafers are a result of more than polishing force mis-distribution.

SUMMARY OF THE INVENTION

Accordingly, it is an object of the present invention to provide a method for producing more consistently polished wafers.

It is another object of the present invention to provide a wafer carrier that delivers uniform heat to a wafer during CMP to thereby achieve more uniform polishing.

It is another object of the present invention to provide a wafer undergoing CMP with insulation against undesired heat sinks or sources.

It is also an object of the present invention to provide wafers that are so polished.

These and related objects of the present invention are achieved by use of a temperature controlled chemical mechanical polishing method and apparatus as described herein.

In one embodiment, the present invention includes a wafer carrier that regulates wafer temperature and thus delivers more uniform heat to a wafer. More uniform heat leads to more uniform CMP and hence greater polish consistency within a wafer and from wafer to wafer.

In another embodiment, the present invention includes either as an alteration to or in addition to temperature regulation of the carrier and wafer, the provision of sufficient insulation between a wafer and the carrier to substantially insulate the wafer from heat sinks or sources provided by the carrier.

The present invention also includes methods of treating a wafer with more uniform heat during CMP and wafers produced by these processes.

The attainment of the foregoing and related advantages and features of the invention should be more readily apparent to those skilled in the art, after review of the following more detailed description of the invention taken together with the drawings.

DETAILED DESCRIPTION

Figure 1:
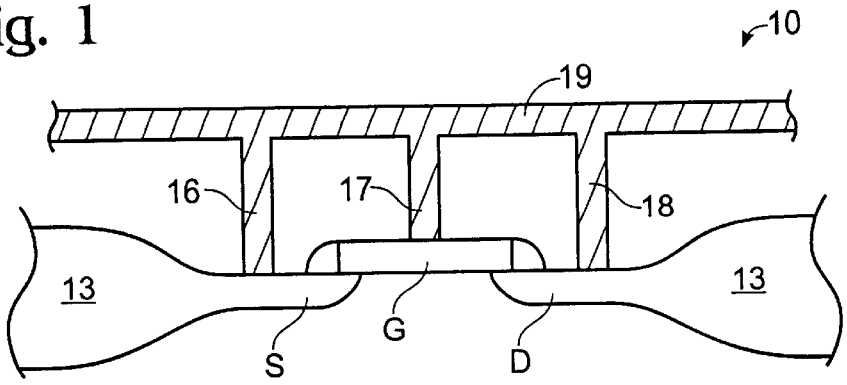
FIG. 1 is a cross-sectional view of a MOSFET transistor during fabrication.
Figure 2:
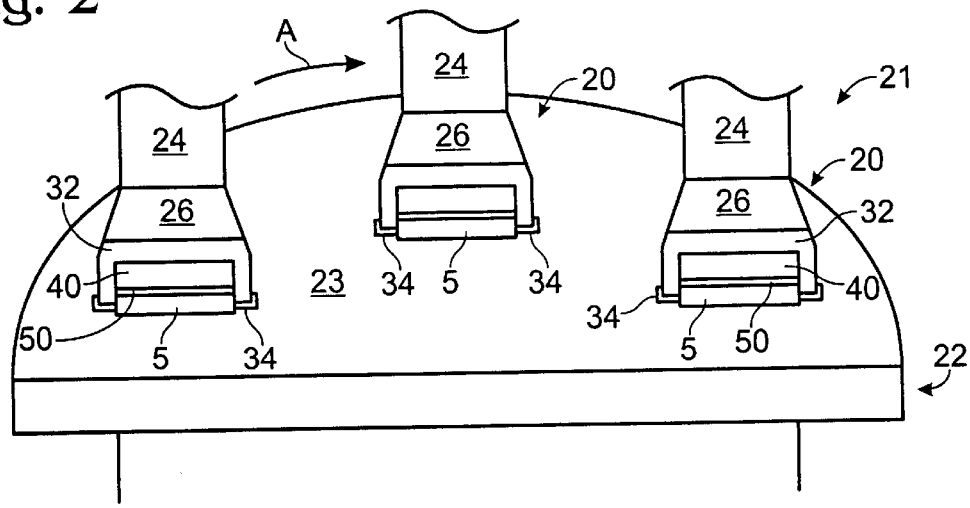
FIG. 2 is a platen and wafer carrier arrangement in accordance with the present invention.

Referring to FIG. 2, a diagram of a platen and wafer carrier arrangement in accordance with the present invention is shown.

Each carrier 20 preferably includes an arm 24, a gimbal 26, a secondary housing 32, a wafer attachment mechanism 34 and a carrier plate 40. The gimbal and secondary housing provide a support member that distributes force from arm 24 and provides attachment to arm 24. A thin film 50 may be provided between the wafer 5 and the carrier plate. The film is provided to compensate for defects in the exterior surface of the carrier plate and hence provide a smoother, cushioned interface between the wafer and carrier plate. This general structure, with or without film 50 in some instances, was used in the following experiments.

In furtherance of the present invention several experiments were conducted and the results of these experiments indicate that wafer temperature has a significant effect on polishing consistency.

In a first experiment, the temperature of one carrier and wafer were elevated relative to the temperature of four other carriers and wafers. Temperature elevation was achieved by placing the subject carrier and wafer in boiling water immediately prior to polishing. The results of this experiment were that the high temperature wafer was polished far worse than the low temperature wafers. It is believed that the higher temperatures create an oxide on the surface to be polished that is more difficult to polish away.

In a second experiment, vacuum pressure was applied through the carrier plate to a first group of wafers and vacuum pressure was not applied to a second group of wafers. The group that was exposed to vacuum had a stronger physical connection to the lower temperature carrier plate and demonstrated greater etching in regions near orifices where the vacuum was applied. It is suspected that the vacuum caused points of greater physical connection which in turn resulted in greater thermal conductivity and heat sink.

In a third experiment, different film 50 thicknesses were utilized. As film thicknesses increased (beyond that needed for protection from surface variations in the carrier plate), the insulation value of the film increased. This in turn resulted in more uniform CMP. It is believed that increased insulation values substantially reduce carrier mediated heat sinks and this affords a more uniform wafer temperature. The more uniform wafer temperature in turn results in more uniform CMP.

These experiments all relate to the provision of a uniform temperature across the surface of a wafer and that such a uniform temperature across a wafer or amongst a plurality of wafers provides more uniform polishing. Appropriate carrier configurations were then developed and tested. The results confirmed this hypothesis and lead to the embodiments of the present invention now described.

Figure 3:
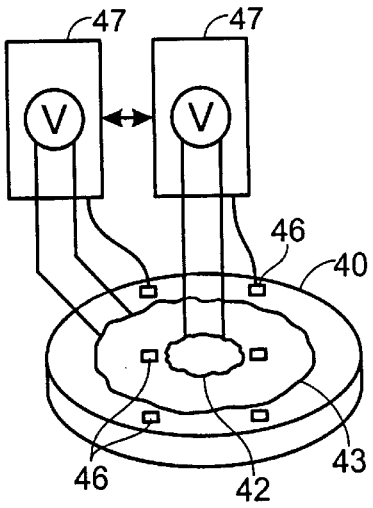
FIG. 3 is an embodiment of a carrier plate for use in a wafer carrier in accordance with the present invention.

Referring to FIG. 3, a perspective view of one embodiment of a carrier plate 40 for use in a wafer carrier 20 in accordance with the present invention is shown. Carrier plate 40 includes temperature control mechanisms to achieve a more uniform temperature across the entire surface of the carrier plate. In the embodiment of FIG. 3, carrier plate 40 includes two piezo electric coils 42,43 which provide central and outer region heat sources or heat sinks, depending on the direction of current flow. Temperature sensors 46 provide temperature feedback through temperature control circuit 47. Control circuit 47 provides current in a first direction to cause a coil to function as a heat source and in an opposite direction to cause a coil to function as a heat sink, as is known. While two coils are shown in FIG. 3, it should be understood that additional coils (and more temperature sensors) could be provided for more precise temperature control.

Coils 42,43 can be formed with carrier plate 40 in a plurality of manners. These include but are not limited to surface mounting, creating channels in the carrier plate and providing the coils in the channels and casting the carrier plate about the coils, etc.

While coils 42,43 are preferably piezo-electric coils, it should be recognized that the coils could be electric coils that serve only as heat sources. Through feedback mechanisms, these coils can provide uniform, albeit elevated, wafer temperature.

Figure 4:
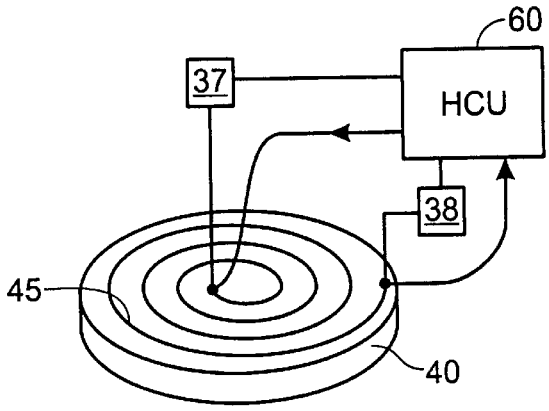
FIG. 4 is an alternative embodiment of a carrier plate for use in a wafer carrier in accordance with the present invention.

Referring to FIG. 4, a perspective view of an alternative embodiment of a carrier plate for use in a wafer carrier in accordance with the present invention is shown. Carrier plate 40 of FIG. 4 has a channel 45 formed therein that spirals out from the center to the periphery of the plate. Heat conducting fluid is circulated through this channel from a heater-chiller unit (HCU) 60. Thermo couple devices 37,38 are preferably connected between the HCU and the center and periphery, respectively, of the carrier plate. The thermo couples provide temperature sensing as is known. HCU 60 along with sensors 37,38 provides appropriate feedback and temperature adjustment.

Carrier plate 40 of FIG. 4 may be made by machining a groove in the surface of a reduced thickness carrier plate component and covering this component with a properly aligned cover disk. The carrier plate component and cover disk are then joined (by adhesive or edge coupling or the like) in such a manner to form a non-leaking, not obstructed channel 45.

Referring again to FIG. 2, a cut-away side view of a three wafer carrier 20 in accordance with the present invention is shown. Wafer carriers 20 preferably include an insulation film 50 that is configured to provide better thermal insulation than prior art films which served only to smooth out bumps and other surface defects on the exterior surface of the carrier plate. By providing good insulation, the effects of carrier plate 40 as a heat sink are substantially reduced or eliminated. By reducing or eliminating carrier plate 40 as a heat sink, the surface temperature of the wafer is more uniformly distributed which results in a more uniform polish.

Film 50 preferably has an R value greater than 1 and more preferably an R value several times greater than 1. film 50 may be formed of polyethylene or polystyrene or any other suitable material. In one preferred embodiment, film 50 is made of polystyrene having a thickness of 3 mm and an approximate R value of 12.

It should be recognized that the present invention includes a temperature regulated carrier without a substantially insulating film, a non-temperature regulated carrier with a substantially insulating film, and a temperature regulated carrier with a substantially insulating film. It should further be recognized that while temperature regulation of the carrier plate is preferred (due to its proximity to the wafer), temperature regulation of other parts of the carrier, e.g., the secondary housing or gimbal, etc., to achieve temperature regulation of a mounted wafer is also within the present invention.

In operation, a wafer 5 is preferably mounted in a carrier 20 and the carrier is temperature regulated to arrive at a set temperature or temperature range. The wafer may be pretreated to this temperature to accelerate processing.

An appropriate slurry (known and commercially available) is then applied to platen 20. The carriers and platen are placed in continuous rotation, if they are not already there, and the carriers and wafers are lowered on to the platen. CMP is performed until a desired level of polishing is achieved. This is followed by rinse and cleaning and other appropriate known processing steps.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A wafer carrier apparatus, comprising:

a support member that provides structural force distribution;

a carrier plate coupled to said support member;

a wafer attachment mechanism that facilitates attachment of a wafer proximate said carrier plate;

a temperature regulating mechanism that regulates the temperature of a wafer mounted by said attachment mechanism; and an insulating member provided exteriorly to said carrier plate, said insulating member substantially insulating a wafer attached by said attachment mechanism from the heat sinking properties of the carrier plate.

2. The apparatus of claim 1, wherein said temperature regulating mechanism is formed integrally with said carrier plate.

3. The apparatus of claim 1, wherein said temperature regulating mechanism is directly coupled to said carrier plate.

4. The apparatus of claim 1, wherein said temperature regulating mechanism includes piezo-electric material.

5. The apparatus of claim 4, wherein said temperature regulating mechanism includes a plurality of piezo-electric elements arranged about said carrier plate.

6. The apparatus of claim 1, wherein said temperature regulating mechanism includes an electrical coil.

7. The apparatus of claim 1, wherein said temperature regulating mechanism includes a conduit provided on or in said carrier plate that is capable of propagating a thermally conductive fluid.

8. The apparatus of claim 1, wherein said insulating member has an R value of approximately 2 or greater.

9. A method of polishing a wafer, comprising the steps of:

providing a wafer;

providing a carrier for the wafer:

regulating a temperature of that wafer;

applying a slurry to the wafer; and mechanically polishing the temperature regulated wafer, wherein said temperature regulating step includes the step of substantially insulating the wafer from the heat sinking properties of the carrier.

10. The method of claim 9, wherein said temperature regulating step includes the step of applying a heat sink or heat source to the wafer in an appropriate manner to achieve more uniform heat distribution over said wafer.

11. The method of claim 9, further comprising the step of providing a carrier to hold the wafer and temperature regulating the wafer by temperature regulating the carrier to which the wafer is attached.

12. The method of claim 11, wherein said carrier temperature regulation step includes the step of regulating temperature at least in part by propagation of appropriate heat sinking or sourcing electrical signals through said carrier.

13. A wafer carrier apparatus, comprising:

a support member that provides structural force distribution;

a carrier plate coupled to said support member;

a wafer attachment mechanism that facilitates attachment of a wafer proximate said carrier plate; and a temperature regulating mechanism that regulates the temperature of a wafer mounted by said attachment mechanism, wherein said temperature regulating mechanism includes piezo-electric material and wherein said temperature regulating mechanism includes a plurality of piezo-electric elements arranged about said carrier plate.

14. The apparatus of claim 13, wherein said temperature regulating mechanism is formed integrally with said carrier plate.

15. The apparatus of claim 13, wherein said temperature regulating mechanism is directly coupled to said carrier plate.

* * * * *